United States Patent [19]

Angevine et al.

[11] 4,250,816

[45] Feb. 17, 1981

[54] PARTICULATE SOLID FUEL COMBUSTION SYSTEM

[75] Inventors: John S. Angevine, Pittsburgh, Pa.; Scott W. Frame, Anniston, Ala.; Stephen B. Yacura, Glenshaw, Pa.

[73] Assignee: Pullman Incorporated, Pullman Swindell Division, Pittsburgh, Pa.

[21] Appl. No.: 751,118

[22] Filed: Dec. 16, 1976

Related U.S. Application Data

[63] Continuation of Ser. No. 687,005, May 17, 1976, abandoned.

[51] Int. Cl.[3] ..... F23K 3/02

[52] U.S. Cl. ..... 110/101 CF; 110/106; 110/104 R

[58] Field of Search ..... 110/101 R, 101 CF, 104 R, 110/105, 106; 432/20, 51, 58, 159; 236/15 BA, 15 BD

[56] References Cited

U.S. PATENT DOCUMENTS

| | | | |
|---|---|---|---|
| 1,898,086 | 2/1933 | Frisch | 110/106 |
| 2,158,673 | 5/1939 | Carter et al. | 110/104 R |
| 2,259,967 | 10/1941 | Jorgensen | 110/106 |
| 2,839,253 | 6/1958 | Yellott | 110/106 |
| 3,043,525 | 7/1962 | Gilbert | 110/106 |
| 3,246,635 | 4/1966 | Powell et al. | 110/106 |
| 3,969,068 | 7/1976 | Miller | 110/106 |
| 4,092,094 | 5/1978 | Lingl, Jr. | 110/106 |
| 4,131,072 | 12/1978 | Lingl, Jr. | 110/106 |
| 4,173,188 | 11/1979 | Pearce | 110/106 |
| 4,182,245 | 1/1980 | Stewart et al. | 110/101 CF |

*Primary Examiner*—Henry C. Yuen

*Attorney, Agent, or Firm*—Buell, Blenko, Ziesenheim & Beck

[57] ABSTRACT

The application discloses a particulate solid fuel combustion system for kilns and the like. A particulate solid fuel such as powdered coal, is supplied to a fluidized bed conveyor. Selected quantities of coal are withdrawn to air entrainment devices where the coal is entrained in a jet of a gas and delivered to a burner. The firing rate is controlled responsive to requirements of the kiln.

8 Claims, 8 Drawing Figures

PARTICULATE SOLID FUEL COMBUSTION SYSTEM

This application is in part a continuation of Application Ser. No. 687,005 of Francis M. Veater and John S. Angevine filed May 17, 1976, now abandoned.

This invention relates to controlling combustion of particulate solid fuels. It is particularly useful in delivering a fuel such as powdered coal to the burners of a tunnel kiln. The combustion system of the present invention makes it possible to provide a long luminous flame in the kiln, thus avoiding hot spots and also to provide automatic temperature control of the burner by regulation of the fuel supply.

Coal fired kilns are old in the art, and coal was commonly used for firing early tunnel kilns. At first coal was supplied to the kiln fire box manually by shoveling. Later, manual shoveling was replaced by automatic stokers which reduced manual labor but were expensive in their own right. Gradually as alternative fuels such as oil and natural gas became generally available and relatively inexpensive, coal was replaced as the primary source of fuel in kilns.

Today, in view of the increasing cost and decreasing availability of oil and natural gas, industry once again is seriously considering returning to coal as the primary source of fuel for new kilns and the modification of existing gas and oil fired kilns to coal firing. This renewed interest in coal for the firing of kilns has led to attempts to develop more facile, economical and efficient means of delivering the coal to the kiln. Feeder systems employing various mechanical and pneumatic delivery means have been developed and air delivery systems employing the principle of the venturi have also been developed. Such systems present various advantages over hand or stoker firing. Although the systems represent an improvement over the older methods, they have not solved all of the problems associated with the delivery of the powdered coal. For example, a powdered coal delivery system of the prior art which utilize venturis which require a hopper for each kiln burner. Also, in a prior art system, the supply of coal for each burner is manually controlled necessitating the attention of skilled attendants.

The present invention provides a novel and significant improvement over present apparatus for the delivery of particulate solid fuels to kilns, furnaces and the like. Fuels such as sawdust, bark, peat, powdered coal or lignite, coke breeze and the like may be used.

We provide fuel storage means, conveyor means receiving the fuel from the fuel storage means and convening it therefrom, air entraining means having connected thereto a fuel supply conduit from the conveyor means, air supply to the air entraining means, fuel-air conduit means for conveying a fuel-air mixture from the entraining means, and burner means positioned in a wall of a kiln and connected to the fuel-air conduit means to receive a fuel-air mixture from the entraining means. We provide variable rate feeder means whereby the amount of fuel being fed to the system can be altered to vary the firing rate of the kiln. In a presently preferred embodiment of the invention we provide a variable rate feeder at the fuel storage means whereby the rate of feed of fuel to the conveyor means can be varied. We further prefer to provide temperatures sensing means in operative relationship to control means whereby the firing rate of the kiln can be selectively controlled. We further prefer to provide means for positively diverting a fixed proportion of fuel from the conveyor means to the fuel supply conduit.

Other details, objects and advantages of our invention will become more apparent as the following description of certain present embodiments of our invention proceeds.

In the accompanying drawings we have illustrated certain present embodiments of our invention including a present preferred embodiment of our invention in which.

Figure 1:
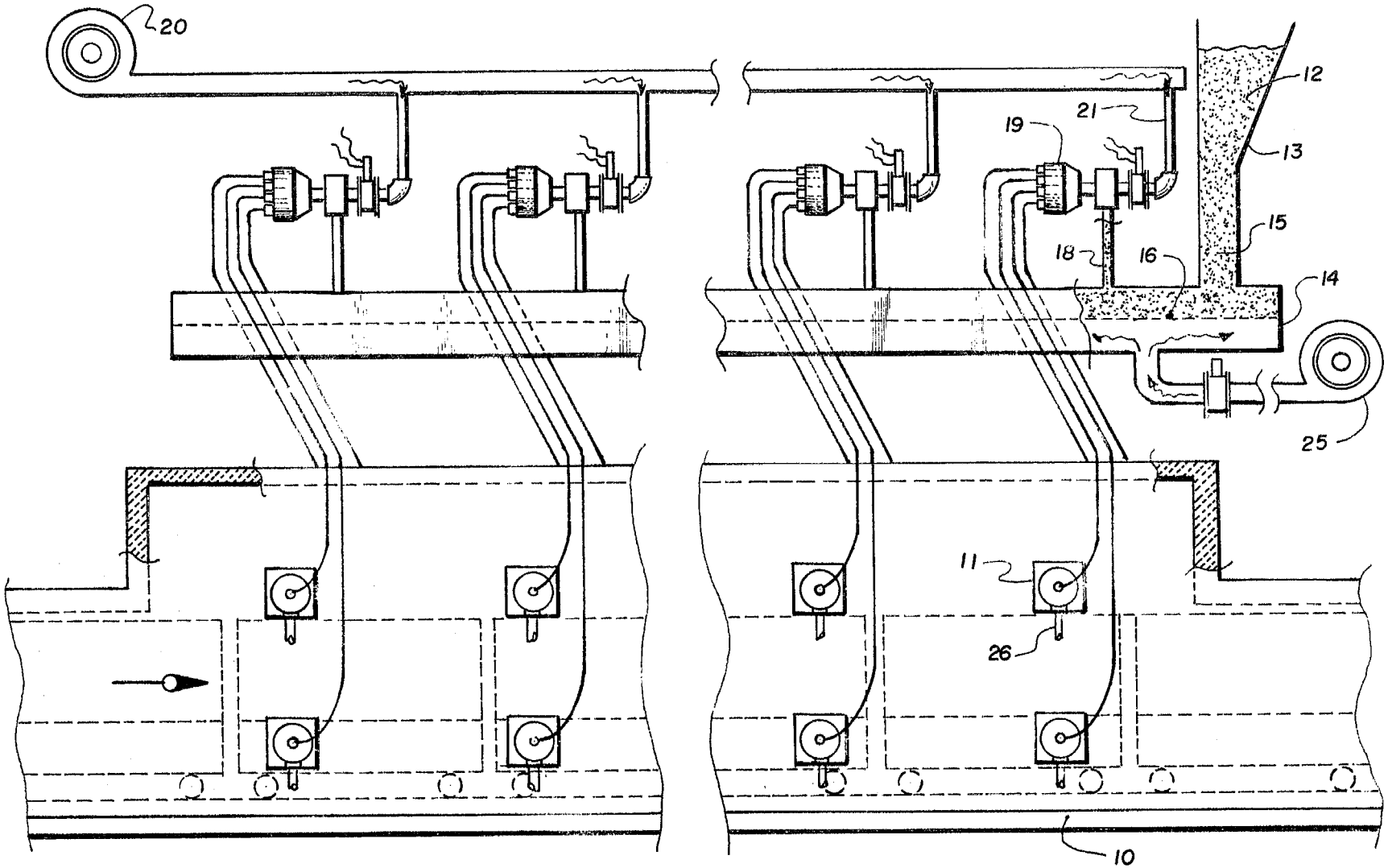
FIG. 1 is a diagrammatic side elevational view, partially in section, showing a kiln and the fuel combustion system of one form of the present invention.

Referring to FIG. 1, kiln 10 has a plurality of burner assemblies 11 in which combustion of the fuel used to fire the kiln is accomplished. Kiln cars and their loads are shown in dotted outline and pass through the kiln from left to right of FIG. 1 as shown by the directional arrow. The burner assemblies are conventional burners which may be fired by particulate solid fuel, or by liquid fuel, or by gaseous fuel.

A convenient solid fuel is powdered coal. The powdered coal supply 12 is contained in hopper 13. The powdered coal supply 12 preferably should contain coal particles of various sizes which are supplied to a fluidized bed conveyor 14 through a chute 15.

Figure 3:
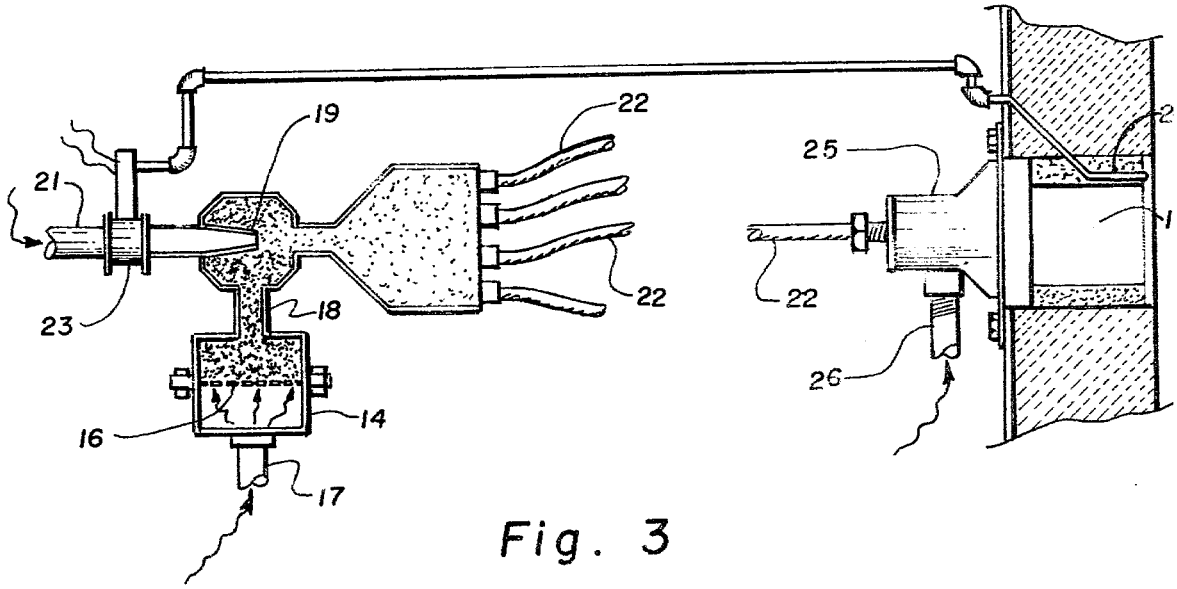
FIG. 3 is a diagrammatic side elevational view, partially in section, of the fuel combustion system of FIG. 1.
Figure 4:
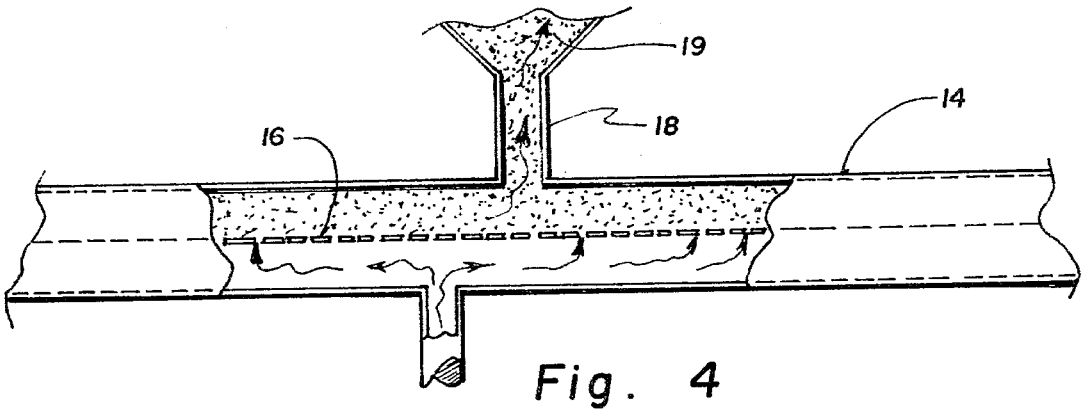
FIG. 4 is a partial side elevational view, partially in section, of the fluidized bed conveyor, coal duct and plenum of the system of FIG. 1.
Figure 5:
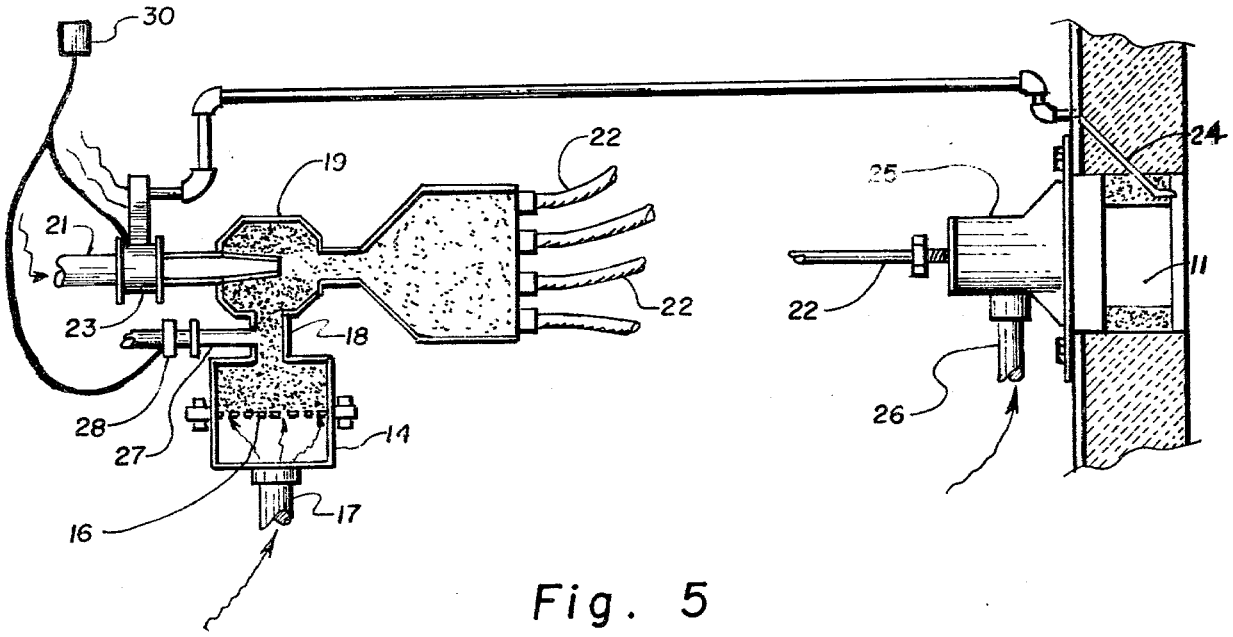
FIG. 5 is a diagrammatic side elevational view of an alternate embodiment of the apparatus of FIG. 3.

Conveyor 14 is made of conventional structural steel parts and which in cross section form a rectangular box-like structure. A perforate member 16 in the form of a ceramic membrane divides the conveyor into upper and lower sections. A supply of support air is fed to the cover sections of conveyor 14 through conduits 17 from a blower which is not shown. The support air is preferably warm to reduce the moisture content of the powdered coal which is delivered to the upper half of conveyor 14. The support air passes upwardly through the membrane and fluidizes the coal within the conveyor permitting coal to move along the conveyor under the influence of gravity and air currents. A coal duct 18 rises from conveyor 18 and extends to a plenum 19. A plurality of such ducts may be provided. The exact number of coal ducts rising from the conveyor being a matter of design choice depending on the number of burners the combustion system is to service. By way of example, four such ducts are illustrated in FIG. 1. A primary air supply from blower 20 travels through conduit 21 across plenum 19 causing a venturi effect in the plenum. Conduit 21 preferably terminates in a nozzle as shown in FIGS. 3 and 5. The venturi effect causes powdered coal 12 to rise from the conveyor into plenum 19 and be carried by the primary air supply into the coal delivery conduits 22. Each conduit 22 extends to a burner 25 located in the wall of the kiln. Each discharge box arrangement comprising coal duct 18 and plenum 19 can support either single coal delivery conduit 22 or a plurality of ducts, for example four, as shown in FIG. 3.

Primary air conduit 21 contains a butterfly control valve 23. Butterfly control valve 23 is electrically controlled by thermocouple 24. Changes in temperature in the kiln are sensed by thermocouple 24 which transmits an electric signal to valve 23 by means well known in the art. This signal which is either an increase or decrease in current causes valve 23 to open or close thereby controlling the flow of primary air through conduit 21 into plenum 19. Valve 23 may also be controlled manually by the operator.

By controlling the flow of primary air the amount of powdered coal entering the plenum for delivery to the burner is also controlled. The temperature control provided by the present invention permits a constant temperature in the burner for better and more complete firing in the kiln.

Burner assembly 11 includes connection 25 for attachment of the coal delivery conduit 22 and a source of secondary air 26 to aid combustion within the burner. The specific details of the burner assembly are known and well understood in the art and need not be explained further.

In operation, powdered coal is delivered by gravity to conveyor 14. Conveyor 14 is sloped at a slight angle, e.g. one to four degrees, to facilitate uniform distribution of the powdered coal along the entire length of conveyor 14. The support air supplied through conduits 17 fluidizes the powdered coal in conveyor 14. Primary air is directed from blower 20 through conduit 21 across plenum 19. This flow causes a venturi effect which causes the powdered coal 12 to rise through duct 18 into plenum 19 and be carried by the primary air through conduits 22 to the burner assemblies. The driving force of the primary air coupled with the difference in particle size of the coal cause combustion of the coal over the entire firing zone.

Thermocouple 24 is preset to maintain a constant temperature in the firing zone of the kiln. If the temperature falls below a preset level, valve 23 is opened by signal from thermocouple 24 and the supply of primary air is increased. The increased flow of air causes an increased amount of powdered coal to enter plenum 19 and to be delivered by conduits 22 to burners 11. Likewise, if the temperature rises over the preset limit, thermocouple 24 will cause valve 23 to reduce the primary air supply and thereby reduce the amount of powdered coal delivered to burners 11. A single thermocouple will adjust the air supply and the resultant fuel supply delivered to four burners in the embodiment shown in FIG. 3. If ducts 18 and plenum 19 support a single coal delivery conduit 22, the firing zone of each burner can be individually temperature regulated.

FIG. 5 shows an alternative form of the present invention. Additional air is delivered through conduit 27 to duct 18 from a blower source, not shown. The air injected into duct 18 assists in causing the powdered coal 12 to rise from the conveyor 14 into plenum 19. This additional air mixes with the primary air to cause delivery of the coal to the burners.

A second butterfly control valve 28, which operates in the same manner as valve 23, can be inserted into conduit 27 to regulate the flow of air into duct 18. Control valve 28 is operably connected to thermocouple 24 and receives a signal together with valve 23 from thermocouple 24 when the temperature of the kiln fluctuates from that preset. The regulation of the flow of secondary air further regulates the amount of powdered coal received from conveyor 14 into plenum 19 for delivery to the burners.

Valves 23 and 28 can operate independently of each other. In this embodiment, valve 28 is operably connected to a second thermocouple, **28*a* by which valve 28** is independently regulated. In this embodiment, it is possible to sense the temperature at various locations within the firing zone and supply coal in response to temperature variations within the firing zone.

Figure 2:
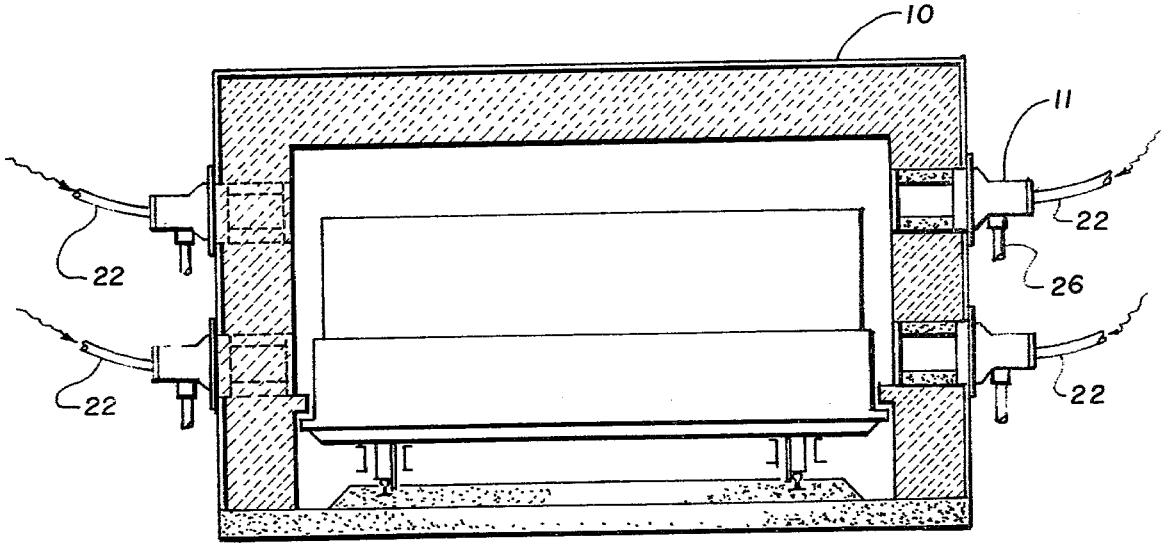
FIG. 2 is a cross section of the kiln of FIG. 1 having over and under burners for load firing.

FIG. 2 shows the present invention used with an arrangement of burners to provide over and under firing of a load. In this embodiment, burners 11 are so positioned on the kiln that firing occurs both over and under the load 29.

The present invention can also be used in a system to provide a sweeping or oscillating of the heat from side to side of the kiln within the operating limits of the apparatus. In this embodiment a timer mechanism 30 would be operably connected by means well known in the art to valve 23. At predetermined time intervals, timer 29 insulates valve 23 from the signal from thermocouple 24 and causes valve 23 to open or close causing a sudden increase or decrease in the air supply and the amount of fuel delivered to the burners. The periodic change increases or decreases the amount of fuel fired sufficiently to cause a sweeping of the flame across the firing zone of the kiln. If the secondary air supply to duct 18 with valve 28 is utilized, timer 30 can be operably connected to valve 28 to have it act in unison with valve 23 to cause oscillation of the flame.

Figure 6:
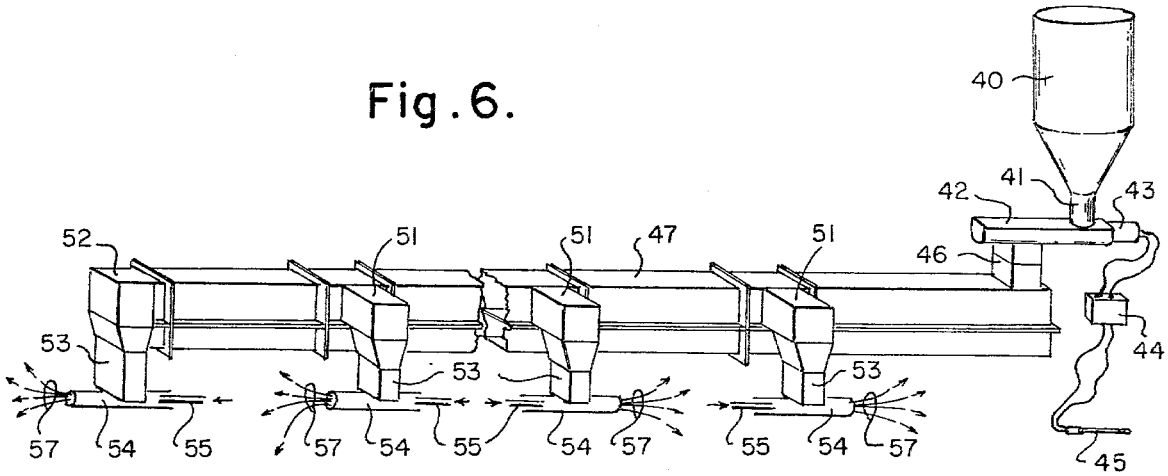
FIG. 6 is a diagrammatic perspective view of the fuel conveyor and associated equipment in a present preferred embodiment of the invention.
Figure 7:
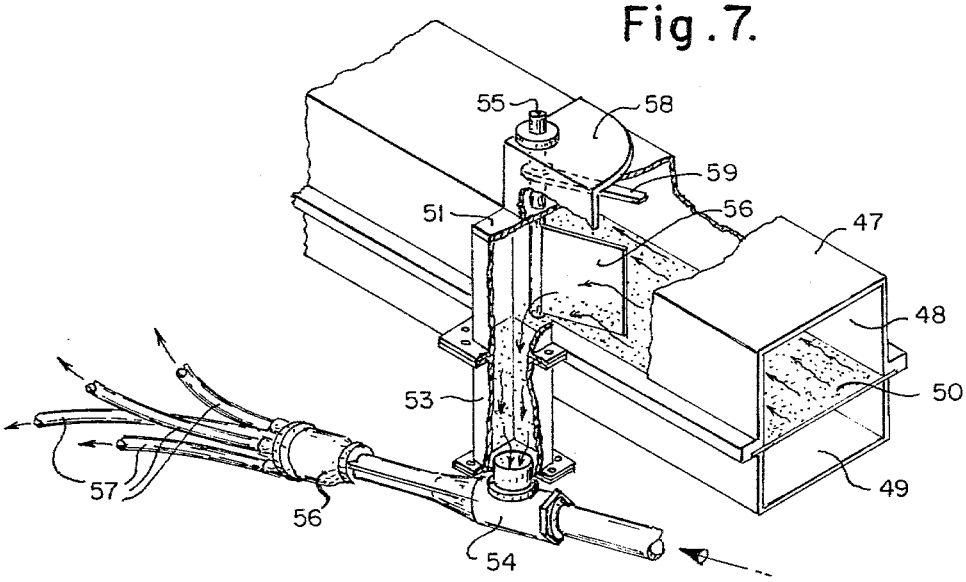
FIG. 7 is a diagrammatic perspective view of one conduit of the embodiment of FIG. 6 for withdrawal of fuel from the conveyor.
Figure 8:
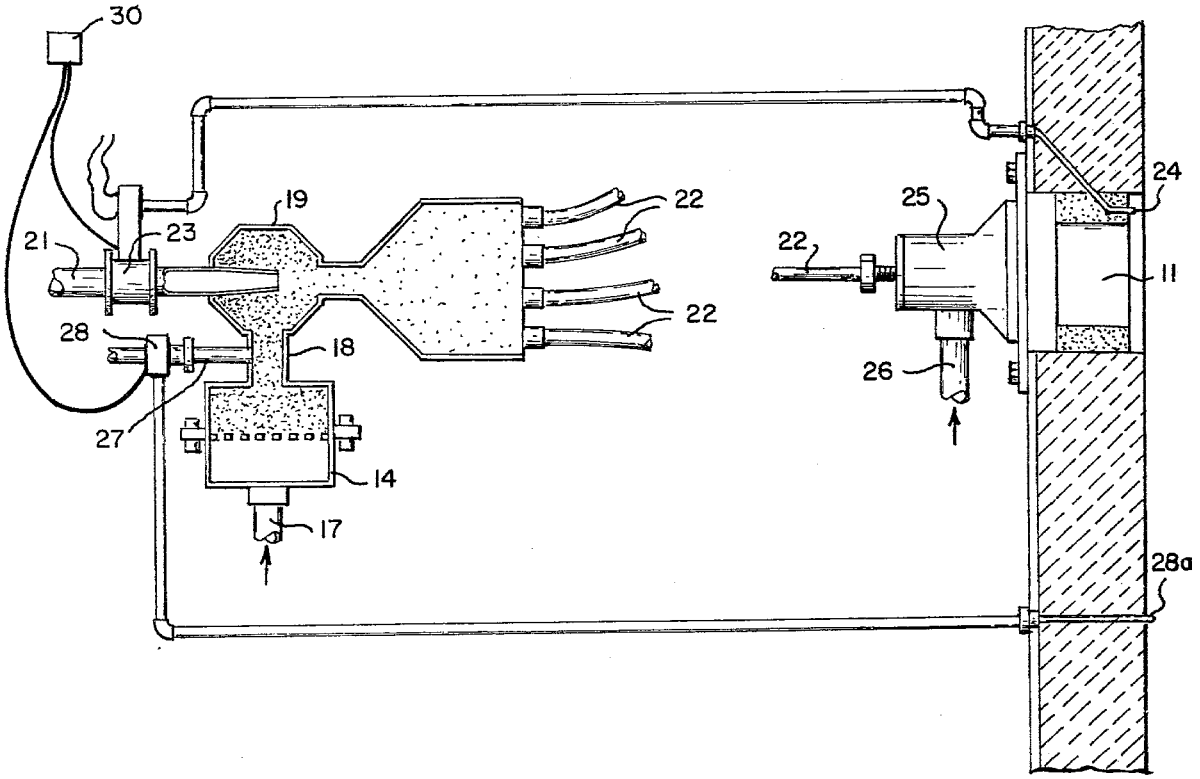
FIG. 8 is a diagrammatic side elevational view similar to FIG. 5 and showing a second thermocouple for separate control of one of the air valves.

A present preferred embodiment of the invention is shown in FIGS. 6 and 7. The particulate solid fuel, powdered coal, for example, is delivered to a storage hopper 40 from which the coal passes by gravity through a discharge gate 41 to a variable rate feeder 42. The storage hopper is formed with a lower conical surface which may be lined with a plastic sheet material having a low coefficient of friction to inhibit bridging of the coal above discharge gate 41. Feeder 42 may be a screw feeder driven by a variable speed motor or may be a variable rate vibrating feeder. Feeder 42 is driven by a motor 43 connected through a controller 44 and wires to a temperature sensing thermocouple 45 positioned in the kiln.

Controller 44 acts to correct the thermocouple signal to a motor current causing changes in the coal feet rate. The controller will increase the feed rate if the temperature drops below a desired level and to reduce the feed rate if the temperature rises above the desired level. The details of the controller are not a part of the invention herein, and any suitable commercially available equipment may be used.

Coal delivered by feeder 42 passes to a discharge chute 46 from which the coal falls into the upper half of a fluidized bed conveyor 47. The conveyor is in the form of a rectangular steel box which is longitudinally divided into an upper half 48 and a lower half 49 by a perforate membrane 50. Membrane 50 may be a porous ceramic member, a wire screen, or a sheet of canvas. Air is supplied under pressure below membrane 50. The air accordingly passes upwardly through the membrane and tends to lift the fine coal particles upwardly in the rising air stream whereby they act in the nature of a fluid. The conveyor is sloped downwardly away from discharge chute 46 and the coal particles tend to move down the slope toward the opposite end of the conveyor.

A series of boxes 51 open from the side of the conveyor communicating with the upper half 48. A further box 52 is located at the end of conveyor 47 remote from fuel storage hopper 40. Each of boxes 51 and 52 has a fuel supply conduit which extends downwardly to fuel entrainment means 54.

A splitter plate is located adjacent each opening from conveyor 47 to box 51. The splitter plate has been omitted from FIG. 6 for clarity of illustration and is shown in FIG. 7. A vertical shaft 55 is positioned in the conveyor downstream of the opening into box 51. A splitter plate 56 is fastened on the shaft and a handle 59 is connected to the shaft in alignment with plate 56. Handle 59 is protected beneath a guard plate 58 mounted on the upper surface of the conveyor. A lock nut or friction bushing may be provided on shaft 55 to hold it in any given angular position.

Each entrainment means 54 is similar to the structure shown in FIG. 3. Each includes a conduit 55 for delivery of primary air and has a manifold 56 from which conduits 57 pass to burners in the kiln to carry a fuel-air mixture.

In the operation of the apparatus in FIGS. 6 and 7 the splitter plates are manually adjusted to secure the desired proportional distribution of coal to each fuel entrainment device 54. If it is desired that each box of FIG. 6 receive an equal amount of coal the first splitter plate might be set to split off one quarter of the moving stream, the second splitter device to split off one third of the moving stream and the third splitter device to cut off one half of the moving stream. The remaining amount would pass into box 51 at the end of the conveyor 47. Fine adjustments can then be made on the basis of operating experience until each of the fuel entrainment means is receiving the desired proportional quantity of fuel. The speed of the feeder is controlled by controller 44 to maintain the kiln temperature at the desired level. If the temperature falls below a preset level the fuel feed will be increased to supply more fuel to the kiln whereas a temperature over-run will cause the speed of the feeder motor to be reduced to feed a smaller quantity of fuel. By reason of the splitter dampers and the location of the fuel entrainment devices below the conveyor, it is possible to make the entire adjustment by controlling only the fuel feed rate while maintaining a constant pressure on the sources of primary and secondary air through the fuel entrainment devices and the burners.

While we have illustrated and describe certain present embodiments of our invention it is to be understood that we do not limit ourselves thereto and that the invention may be otherwise variously practiced within the scope of the following claims.

We claim:

1. A particulate solid fuel combustion system comprising:

(a) fluidized bed conveyor means having operably connected thereto a source of air for fluidizing the fuel within said conveyor, (b) a controlled delivery system for delivery of said fuel to said conveyor, (c) a plurality of duct means operably connected to said conveyor, each said duct means having plenum means at the end opposite the connection to said conveyor, (d) primary air duct means operably connected to each said plenum to cause said fuel to enter said plenum from said conveyor, (e) valve means operably connected to said primary air duct means for controlling the flow of primary air through said conduit means and into said plenum, (f) fuel delivery means operably connected to said plenum and to the burners of a kiln through which said fuel is delivered by said air from said plenum to said burners; and (g) heat sensing means within the firing zone of said kiln said heat sensing means operably connected to said valve means within said primary air conduit means to regulate said control valve means with relation to the temperature of said kiln.

2. The apparatus of claim 1 wherein said conveyor means is slanted 1 to 4 degrees with respect to the horizontal.

3. The apparatus of claim 2 wherein said valve means is activated by an electronic signal.

4. The apparatus of claim 3 wherein said heat sensing means is a thermocouple.

5. The apparatus of claim 3 wherein electric timer means is operably connected to said control valve means to isolate said valve means from said heat sensing means, said timer causing said control valve to periodically fully open and fully close to cause oscillation of the flame caused by combustion of said fuel across said firing zone of said kiln.

6. A powdered fossil fuel combustion system comprising:

(a) fluidized bed conveyor means having operably connected thereto a source of warm air for fluidizing the fuel within said conveyor and reducing the moisture content thereof, (b) a gravity controlled chute delivery system operably connected to said conveyor for delivery of said fuel to said conveyor at a constant predetermined rate, (c) a plurality of duct means operably connected to said conveyor, said duct means having plenum means at the end opposite the connection to said conveyor, (d) a primary air conduit means operably connected to said plenum means to cause said fuel to enter said plenum from said conveyor, (e) secondary air conduit means operably connected to said duct means to cause said fuel to enter said duct means from said conveyor, (f) valve means operably connected to said primary air conduit means and said secondary air conduit means for controlling the flow of primary and secondary air conduit means into said plenum and said duct, (g) fuel delivery means operably connected to said plenum means and the burners of a kiln through which said fuel is delivered by said primary air and secondary air from said plenum to said burners to fire said kiln; and (h) a thermocouple operably connected to first valve means within said primary air conduit means and a second thermocouple operably connected to second valve means within said secondary air conduit means to regulate said valve means with relation to the temperature variations within said kiln temperature means.

7. The apparatus of claim 6 wherein said conveyor means is slanted 1 to 4 degrees with respect to the horizontal.

8. The apparatus of claim 7 wherein electric timer means are operably connected to said first and second control valve means to isolate said valve means from said thermocouple means, said timer means causing said control valves to periodically fully open and fully close to cause oscillation of the flame caused by combustion of said fuel across said firing zone of said kiln.

* * * * *

UNITED STATES PATENT AND TRADEMARK OFFICE

CERTIFICATE OF CORRECTION

PATENT NO. : 4,250,816

DATED : February 17, 1981

INVENTOR(S) : JOHN S. ANGEVINE, SCOTT W. FRAME and STEPHEN B. YACURA

It is certified that error appears in the above-identified patent and that said Letters Patent are hereby corrected as shown below:

Column 2, line 30, after "conveyor;" --and-- should be inserted.

Column 2, line 60, "conveyor 18" should read --conveyor 14--.

Signed and Sealed this

*Second* Day of *June 1981*

[SEAL]

*Attest:*

RENE D. TEGTMEYER

*Attesting Officer*

*Acting Commissioner of Patents and Trademarks*